US005266056A

United States Patent [19]

Baderschneider et al.

[11] Patent Number: 5,266,056

[45] Date of Patent: Nov. 30, 1993

[54] ELECTRICAL TERMINAL HAVING IMPROVED RETENTION MEANS

[75] Inventors: Kurt P. Baderschneider, Dreieich; Gheorghe Hotea, Greisheim, both of Fed. Rep. of Germany

[73] Assignee: The Whitaker Corporation, Wilmington, Del.

[21] Appl. No.: 971,444

[22] Filed: Nov. 4, 1992

[30] Foreign Application Priority Data

Nov. 20, 1991 [GB] United Kingdom ..... 9124572

[51] Int. Cl.[5] ..... H01R 13/434

[52] U.S. Cl. ..... 439/745; 439/746

[58] Field of Search ..... 439/744, 745, 746

[56] References Cited

U.S. PATENT DOCUMENTS

| | | | |
|---|---|---|---|
| 3,654,592 | 4/1972 | Primorac | 439/746 X |
| 4,371,227 | 2/1983 | Yoshimura | 439/746 |
| 4,750,893 | 6/1988 | Sueyoshi et al. | 439/596 |
| 4,880,401 | 11/1989 | Shima et al. | 439/746 |

*Primary Examiner*—Eugene F. Desmond

*Attorney, Agent, or Firm*—Eric J. Groen; Timothy J. Aberle

[57] ABSTRACT

An electrical terminal (2,102) is shown having a pin (4) or socket contacts (104) a retaining spring (6) and an insulation crimping barrel (8). The retaining spring (6) is defined as a substantial box section where the upper wall (36) includes a stamped out locking lance (38) having a free end (40) for engaging a locking shoulder within an electrical terminal housing. The free end (40) of the locking lance (38) has an embossed section (42) forming a raised surface on the upper surface (44) of the locking lance and an indentation (50) on the lower surface (46) of the locking lance. The embossed area (42) extends into the free end (40) of the electrical terminal so as to define a discontinuous end edge for engaging the locking shoulder of the electrical terminal housing. Medially positioned within the embossed area (42), and extending from the free end (40) thereof, is a sheared tab (54) defined by sheared slits (52). The sheared tab (54) is depressed downwardly to further emphasize the discontinuous end edge for the locking lance.

8 Claims, 4 Drawing Sheets

ELECTRICAL TERMINAL HAVING IMPROVED RETENTION MEANS

BACKGROUND OF THE INVENTION

1. Field of the Invention

This invention relates to an electrical terminal with improved means for retaining the terminal in a terminal receiving passageway of a connector housing.

2. Description of the Prior Art

It is common in the electrical connector industry to require that electrical terminals have redundant retention means for retaining electrical terminals in the connector housings. The first or primary means of retaining the electrical terminals within the housing is to have a stamped out lance from the electrical terminal metal body which abuts a shoulder within the connector housing. The redundant or secondary retention means is typically profiled as a plastic movable member which can be moved into place over an edge or shoulder of the electrical terminal to lock the terminal in place in the connector housing. Some of these members are moved transversely of the axial direction, while some are defined as hinged flaps which are pivotly rotated into place. These flaps include plastic tabs which, when rotated, reside in the groove or gap within the terminal to cooperate with the terminal in order to retain the terminal in place.

In one prior method, as shown for example in U.S. Pat. No. 4,750,893, an electrical connector housing has a hinged flap which rotates or pivots into place in the housing. The electrical connector has an insulating housing and a plurality of pin terminals disposed in terminal receiving passageways within the housing. The housing includes an upper retention flap including a retention tab which, when in it's locked location, is positioned adjacent to an edge of the pin terminal to retain the pin terminal in the passageway. The flap has tabs which reside at an edge of the contact to prevent withdrawl thereof. If more than one row of contacts are presented, the two flaps on the outside of the two rows are used to retain the pin terminals in place.

One of the problems with the presently designed locking lances is that they have a tendency to buckle when an external pull-out force is exerted on the wire to which the electrical terminal was coupled. This often causes the terminals to become disconnected from the complementary electrical connector or device to which it was connected. This also resulted in the electrical terminal having a less than desirable pull-out force (i.e. the force required to pull the terminal out of housing). Another problem with the electrical terminals is that the locking lances include a continuous sheared edge which when pulled against the plastic shoulder of the connector housing can have a tendency to shear or cut away at the plastic shoulder in the connector housing and eventually dislodge the terminal from within the terminal receiving passageway.

The above mentioned problems can lead to one of more electrical terminals being pulled back from their fully inserted position. When a mating connector is installed, the associated contact could actually force the lose terminals out of the housing rather than making electrical contact with them, which would lead to an open connection. If the terminals are damaged or otherwise removed from the housing, installing new terminals into the assembly is quite difficult as the connectors and the electrical wires are intertwined within an extensive array of harnesses, which would require disassembling a large extent of the harness. It is therefore an object of this invention to provide an electrical terminal for use in a connector housing which has improved means for retaining the electrical terminal within the receiving passageway of a connector housing.

Another object of this invention is to provide a lance having an engaging surface which facilitates distributing the pull-out force of the lance over a larger area, so as to minimize the shearing action of the free end of the lance. Another object of this invention is to provide an electrical terminal comprising a lance having an embossed area which facilitates strengthening the lance, thereby increase the pull-out force of the electrical terminal.

Yet another object of this invention is to provide a lance having an engaging surface which is irregular in cross-section such that when a wire is pulled, the force, with which an edge of the lance engages the shoulder in the terminal receiving passageway, is distributed in a non-continuous way on the shoulder, thereby increasing the area over which the shearing force is exerted.

SUMMARY OF THE INVENTION

The above mentioned objects have been accomplished by providing an electrical terminal for use in a connector housing having a terminal receiving passageway for receiving the terminal where the terminal receiving passageway includes a latching shoulder to retain the terminal therein, the terminal comprising a conductor engaging section for coupling to a conductor, a mating contact section having at least one contact surface for making contact with a complementary connector, and a resilient locking lance having a free end with an embossed area so as to strengthen said locking lance along the axial length thereof.

DETAILED DESCRIPTION OF THE PREFERRED EMBODIMENT

Figure 1:
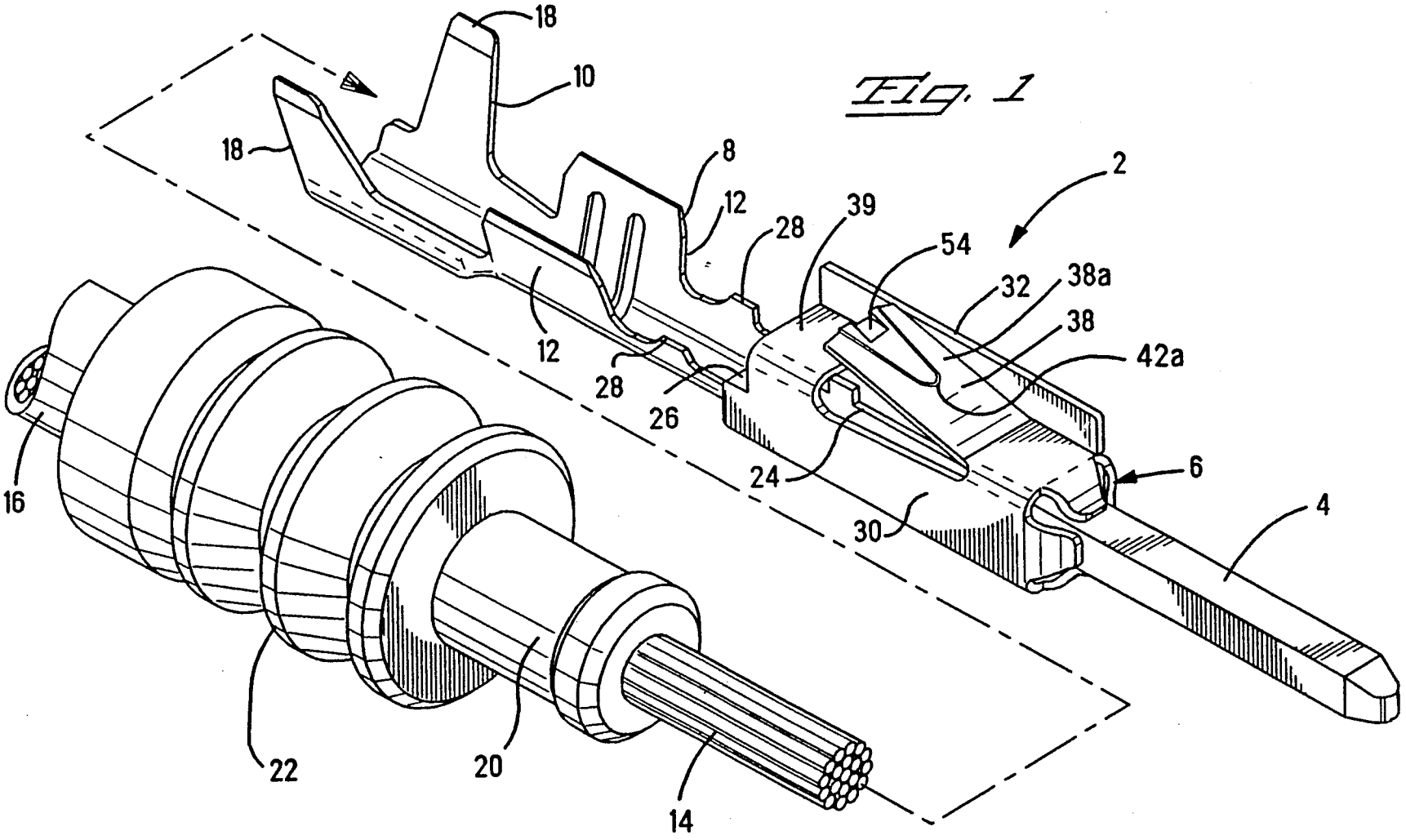
FIG. 1 is an isometric view of a pin terminal in accordance with the preferred embodiment of the invention.

With reference now to FIG. 1, an electrical pin terminal is shown generally at 2 comprising a pin contacting section 4, a retaining section 6, a crimp section 8 and a strain relief section 10. It should be appreciated that the crimp section 8 includes individual side walls 12 for crimping to the conductors 14 of an insulated wire 16, and the strain relief section 10 includes individual arms 18 which can overlappingly wrap around the insulation of an insulated wire, or can be crimped around the neck 20 of a rubber grommet such as 22 shown in FIG. 1.

With respect still to FIG. 1, the electrical pin terminal 2 further includes a channel section 24 which extends forward from the crimped section 8 and in the case of the pin terminal retains the pin portion 4. In the preferred embodiment of the invention, the retaining spring 6 is fixed to the channel section 24 of the pin terminal 2 by way of foldable arms 26 as shown in FIGS. 1 and 3 which can be folded and crimped to individual side walls 28 which form the channel 24.

Figure 3:
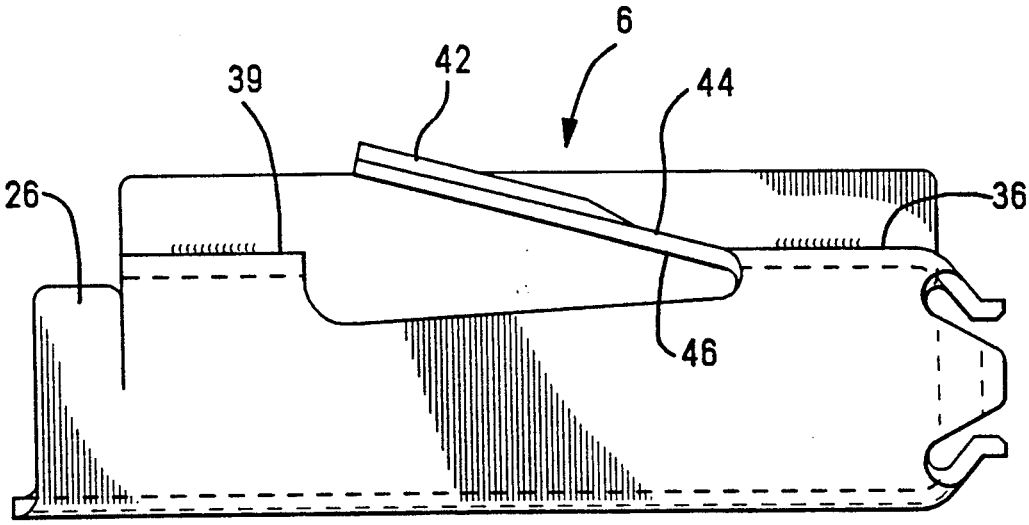
FIG. 3 is a side view of the locking spring containing the locking lance of the preferred embodiment of the invention.
Figure 4:
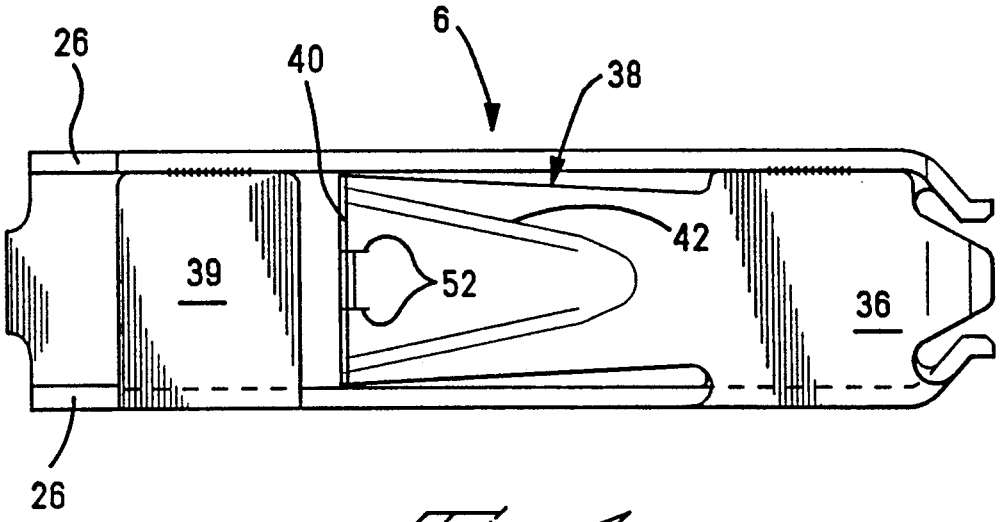
FIG. 4 is an upper view of the spring of FIG. 3.
Figure 5:
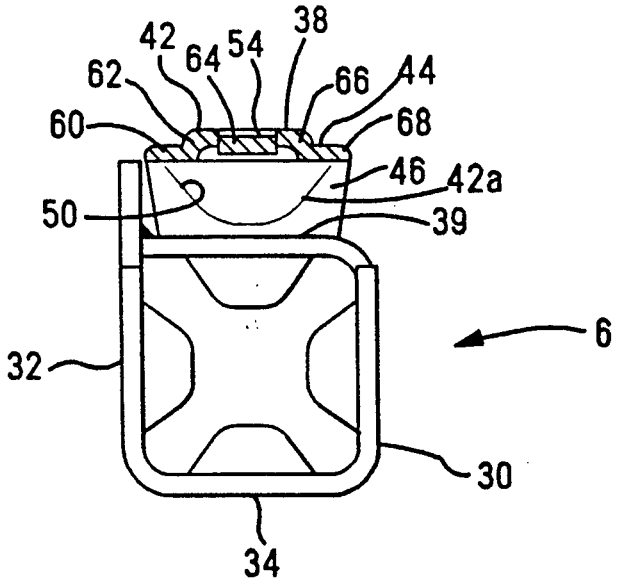
FIG. 5 is an end view of the spring shown in FIGS. 3 or 4 looking towards the free end of the locking lance.
Figure 6:
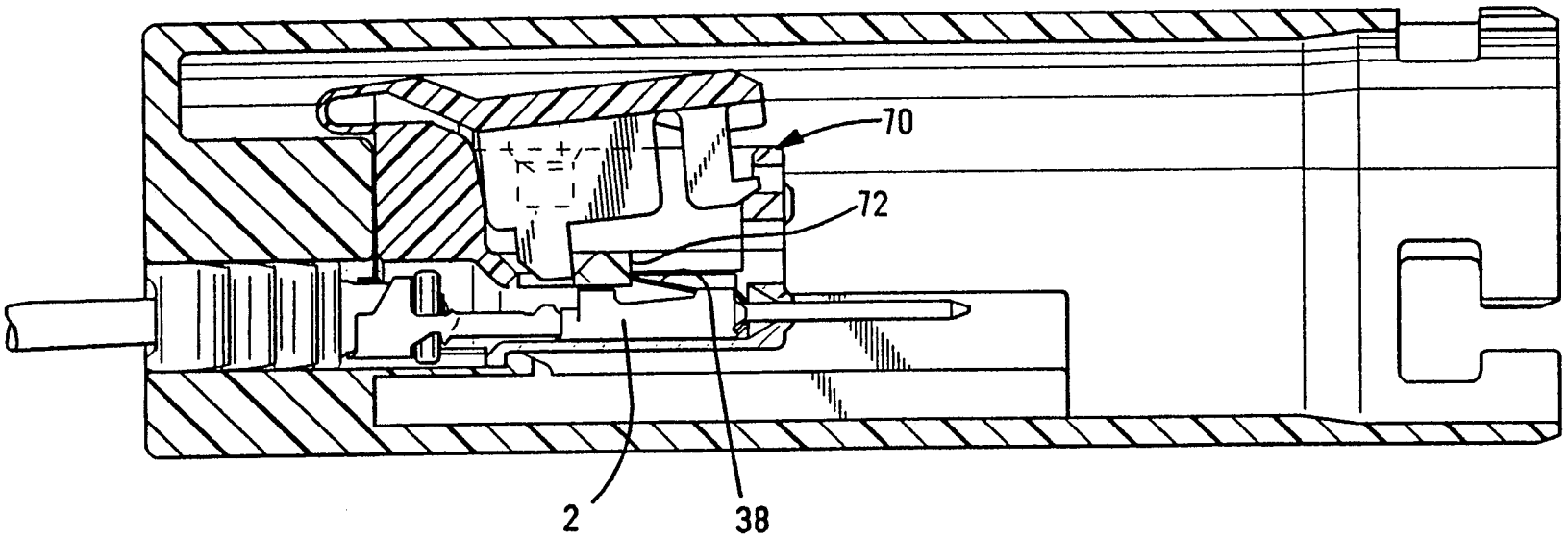
FIG. 6 shows an illustrative example of the electrical terminal positioned in an electrical connector housing.

With reference now to FIGS. 3-5, the retaining spring 6 is shown in greater detail as comprising a box shaped structure including side walls 30 and 32 interconnected by a lower wall 34 and having an upper wall 36 having an integrally contained locking lance shown generally at 38. The locking lance 38 is formed from a portion of the upper wall 36 and is bent upwardly obliquely relative to the upper wall 36, and resultantly leaving a bendable strap portion 39, as shown best in FIGS. 1 and 4 which also assists in retaining the spring to the terminal body 24.

In a preferred embodiment of the invention, the locking lance includes adjacent to its free end 40 (FIG. 4) a substantially V-shaped embossed area 42 which embossment deforms both the upper and lower surfaces 44 and 46 of the locking lance. This is shown best in FIG. 3 where the embossed area 42 is shown raised from the plane of the upper surface 44 of the locking lance 38. This can also be seen from FIG. 5 where the embossment 42 defines an indentation 50 projecting into the lower surface 46 of the locking lance. It should be appreciated that this embossment strengthens the locking lance along its axial length, decreasing the liklihood of buckling.

In the preferred embodiment of the invention, the free end 40 of the locking lance is also sheared along two shear lines 52 as best shown in FIG. 4 to define a central tab portion 54 as shown in FIG. 1, which is displaced downwardly relative to the embossed area 42, as best shown in FIG. 5. As best shown in FIG. 5, the combination of the embossment 42 and the sheared tab 54 defines a staggered and discontinuous distal end surface defined by edges 60, 62, 64, 66 and 68. It should be appreciated that this discontinuous end edge provides for distributing the force exerted on a pulled wire over a larger area of a retaining shoulder within an electrical connector housing thereby reducing the overall pressure and minimizing the risk of shearing away the plastic which forms the shoulder.

Figure 2:
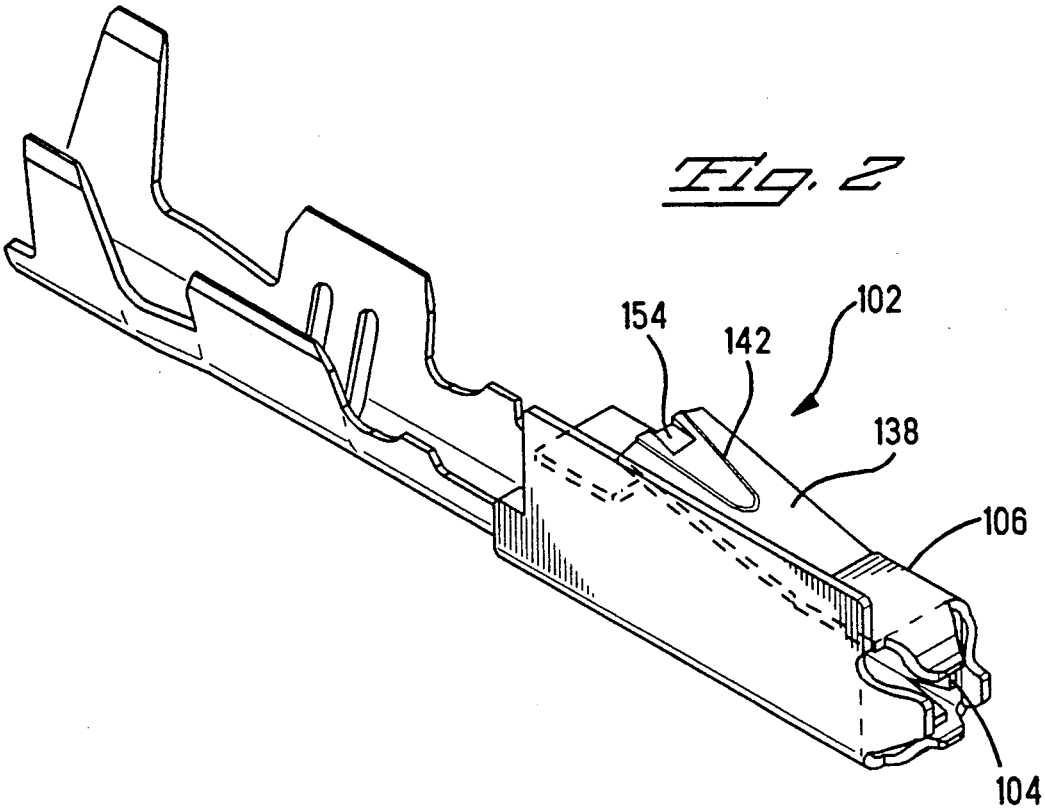
FIG. 2 is an isometric view of a socket terminal in accordance with the preferred embodiment of the invention.

With respect now to FIG. 2 it should be apparent that this invention is not limited to electrical pin terminals but can also be used on a complementary socket type electrical terminal shown generally at 102 having a retaining spring 106 overlapping mating contact 104. The locking lance 138 would be identical to that described above having an embossed area 142 and a sheared tab 154.

For illustrative purposes only, electrical pin terminal 2 is shown installed in the electrical connector housing as described in European patent application 0 424 887 where the terminal is inserted within an inner housing 70, the retaining lance 38 abutting a shoulder 72 of the housing 70 to maintain the terminal 2 within the housing.

As mentioned above, the improved configuration of the locking lance as described above has exhibited higher pull-out forces to disconnect the terminal from a retaining shoulder. As described above, the improved locking lance has shown an increase of 10% in the pull-out force required to remove the electrical terminal.

It should be appreciated that the pin and socket terminals 2 and 102 as described herein are only representative of the preferred embodiment of the invention and should not be limiting to the claimed invention. More specifically the locking lance shown on either of the pin or socket terminal could be connected directly to the terminal body rather than being inclusive on a separate and discrete retaining spring as described herein. Furthermore while the preferred embodiment of the invention includes the embossed area having an immediately positioned tab is within the scope of the invention to change the shape of the discontinuous end edge to perform the teachings and to gain the advantages as described herein.

We claim:

1. An electrical terminal for use in a connector housing having a terminal receiving passageway for receiving the terminal and a latching shoulder associated with said terminal receiving passageway, said terminal comprising:

a conductor engaging section for coupling to a conductor;

a mating contact section having at least one contact surface for making contact with a complementary connector;

and a resilient locking lance having an embossed area that has a distal edge at a free end and a terminal edge at about a mid-section of said locking lance so as to strengthen said locking lance along the axial length thereof.

2. The electrical terminal of claim 1, wherein the locking lance is carried by a retainer spring which is held to a body section of the terminal.

3. The electrical terminal of claim 1, wherein said embossed area extends into said free end and includes at least one shear line at said free end, thereby defining a discontinuous latching edge.

4. The electrical terminal of claim 3, wherein said latching edge includes a sheared tab, generally positioned medially of said embossed area.

5. The electrical terminal according to claim 4, wherein said sheared tab extends into said embossed area.

6. An electrical terminal having a conductor engaging section, and a locking lance to retain the terminal within an associated housing, said terminal being characterized in that:

said locking lance has an engaging edge at a free end thereof, and wherein said free end includes a sheared tab which extends into an embossed area formed on said lance, whereby said free end is adapted to distribute any pull-out forces over an enlarged area.

7. The terminal of claim 6, characterized in that said embossed section is raised outwardly relative to an outer surface of said locking lance.

8. A primary locking lance for preventing an electrical terminal from becoming withdrawn from an electrical connector housing, said primary locking lance comprising:

a resilient latch associated with said terminal; and an embossed area associated with an end of said resilient lance for strengthening said lance so as to enhance the pull-out force required to pull the pin terminal out of the electrical connector, wherein said embossed area is sheared to provide a staggered engaging surface.

* * * * *